United States Patent [19]

Gallusser et al.

[11] 4,362,349

[45] Dec. 7, 1982

[54] ELECTRICAL CONNECTOR HOUSING WITH INTEGRAL RETENTION MECHANISM

[75] Inventors: David O. Gallusser, Oneonta; Valentine J. Hemmer, Sidney; Gary C. Toombs, Oneonta, all of N.Y.

[73] Assignee: The Bendix Corporation, Southfield, Mich.

[21] Appl. No.: 206,771

[22] Filed: Nov. 14, 1980

[51] Int. Cl.[3] ..... H01R 13/639

[52] U.S. Cl. ..... 339/89 M; 339/DIG. 2

[58] Field of Search ..... 339/DIG. 2, 89 R, 89 C, 339/89 M, 90 R, 90 C; 285/82, 86, 89, 92

[56] References Cited

U.S. PATENT DOCUMENTS

| | | | |
|---|---|---|---|
| 3,917,373 | 11/1975 | Peterson | 339/89 R |
| 3,947,081 | 3/1976 | Peterson | 339/DIG. 2 |
| 4,109,990 | 8/1978 | Waldron et al. | 339/89 M |
| 4,154,496 | 5/1979 | Gallagher | 339/89 R |

FOREIGN PATENT DOCUMENTS

| | | |
|---|---|---|
| 2719730 | 11/1978 | Fed. Rep. of Germany . |
| 2005489 | 4/1979 | United Kingdom . |

*Primary Examiner*—John McQuade

*Attorney, Agent, or Firm*—Raymond J. Eifler

[57] ABSTRACT

A plurality of integrally molded fingers (21) extend outwardly and forwardly from the rear portion of a housing (20) to captivate an annular shoulder (11) of a coupling member (10) between the fingers (21) and an annular shoulder (22) on a housing (20).

4 Claims, 3 Drawing Figures

FIG. 1
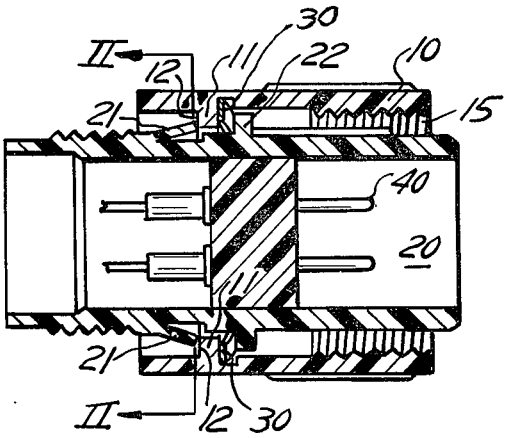
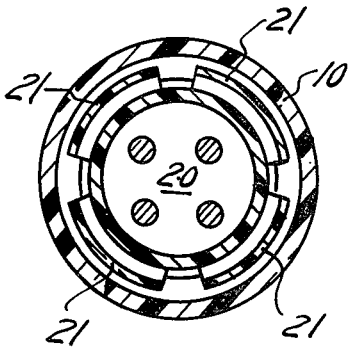
FIG. 2
FIG. 3
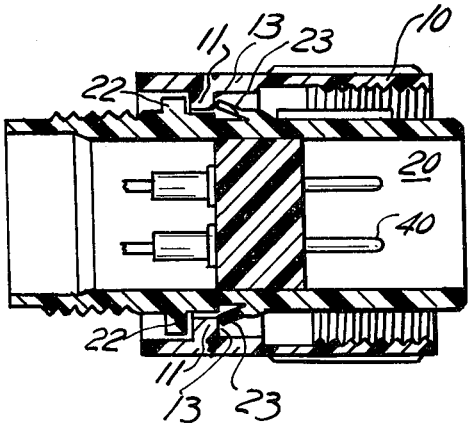

ELECTRICAL CONNECTOR HOUSING WITH INTEGRAL RETENTION MECHANISM

This invention relates to an electrical connector assembly of the type having a first housing having a plurality of electrical contacts mounted therein and adapted to connect to a second housing having a plurality of contacts mounted therein and adapted to mate with the contacts in the first housing, and a coupling member that connects the two housings together.

Most electrical connector assemblies involve one of two basic approaches to retain a coupling member to one of the housings. The first approach uses a snap ring behind the coupling member to captivate an internal shoulder of the coupling member between the snap ring and a shoulder on the housing. The second approach uses another member which screws on behind the coupling member to hold the coupling member in place. Both approaches function very well, but they both require assembly time and involve a third member. An example of one of these approaches that requires a third member may be found in U.S. Pat. No. 4,109,990, issued Aug. 29, 1978 and entitled "Electrical Connector Assembly Having Anti-Decoupling Mechanism".

DISCLOSURE OF THE INVENTION

The invention eliminates the need in an electrical connector for an extra piece to mount the coupling member to a connector housing by providing a coupling retention mechanism that is integrally molded with the connector housing.

The invention is an electrical connector characterized by a plurality of resiliently deflectable fingers which have longitudinal axes extending outwardly from the connector housing and which abut against the shoulder of a coupling ring to captivate the coupling ring shoulder between a shoulder on the housing and the deflectable fingers.

One advantage of the invention is that it provides a new approach to mounting a coupling member to a connector housing.

Another advantage of the invention is that the retention mechanism eliminates the need for an additional member to mount the coupling member to the housing.

Another advantage of the invention is that it reduces the time required to assemble the coupling member to the connector housing.

DETAILED DESCRIPTION OF THE INVENTION

FIG. 1 is a diagrammatic view of an electrical connector embodying the principles of the invention.

FIG. 2 is a cross-section of an electrical connector taken along lines II—II in FIG. 1.

FIG. 3 is an alternate embodiment of the invention.

Referring now to the drawings, FIG. 1 illustrates an electrical connector which generally includes a housing 20, having a plurality of contacts 40 mounted therein, and a coupling nut 10 mounted to the connector housing 20.

The coupling nut 10 generally includes a plurality of threads in the forward portion for coupling to similar threads on another connector housing, and an annular inwardly extending shoulder 11 which has a rearwardly facing surface 12.

The connector housing 20 includes an annular shoulder 22 and a plurality of outwardly extending and resiliently deflectable fingers 21.

The coupling member 10 is mounted in the housing 20 by being captivated between the annular shoulder 22 and the forwardly extending fingers 21. A wave washer 30 provides a bias between the annular shoulder 22 of the housing and the annular shoulder 11 on the coupling nut 10.

FIG. 2 is a cross section of the connector shown in FIG. 1 and illustrates the arrangement of the forwardly extending fingers 21 which are integral with the connector housing 20. In the preferred embodiment the connector housing is molded from a plastic such as Torlon (polyamide-imide), or any other similar material that is rigid and tough.

FIG. 3 illustrates an alternate embodiment of the invention wherein the integral retention fingers 23 are rearwardly facing to captivate the coupling nut shoulder 11 between the annular shoulder 22 of the housing and the retention fingers 23 extending from the housing 20.

While a preferred embodiment of the invention has been disclosed, it will be apparent to those skilled in the art that changes may be made to the invention as set forth in the appended claims, and in some instances, certain features of the invention may be used to advantage without corresponding use of other features. For example, although the preferred embodiment illustrates a cylindrical electrical connector, the invention applies to a rectangular connector housing also. Further, the fingers 21, 23 may or may not be molded as an integral part of the housing 20. Accordingly, it is intended that the illustrative and descriptive materials herein be used to illustrate the principles of the invention and not to limit the scope thereof.

Having described the invention what is claimed is:

1. In combination with an electrical connector of the type having: a housing having a central axis, a forward surface portion, a rear portion and a middle portion that includes an annular shoulder extending outwardly from said central axis; at least one electrical contact mounted in said housing; a tubular coupling member disposed around a portion of said housing, said coupling member having a rear portion that includes an annular shoulder extending inwardly towards said central axis and a forward portion adapted to connect to a similar housing having at least one contact adapted to mate with said contact in said housing; and means for mounting the coupling member to said housing, the improvement wherein the means for mounting said coupling member comprises:

at least one finger integrally molded with and having a longitudinal axis extending outwardly and rearwardly from the forward surface portion of said housing, said finger resiliently and radially deflectable inwardly towards the central axis of said housing, the rearwardly facing end of said finger abutting the forward face of the annular shoulder of said coupling member, whereby said coupling member is mounted to said housing and may be removed from said housing by deflecting said finger.

2. The electrical connector as recited in claim 1 wherein there are a plurality of fingers intergral with said housing.

3. In combination with an electrical connector of the type having: a housing having a central axis, a forward portion, a rear surface portion and a middle portion that includes an annular shoulder extending outwardly from said central axis, at least one electrical contact mounted in said housing; a tubular coupling member disposed around a portion of said housing, said coupling member having a rear portion that includes an annular shoulder extending inwardly towards said central axis and a forward portion adapted to connect to a similar housing having at least one contact adapted to mate with said contact in said housing; and means for mounting the coupling member to said housing, the improvement wherein the means for mounting said coupling member comprises:

at least one finger integrally molded with and having a longitudinal axis extending outwardly and forwardly from the rear surface portion of said housing, said finger resiliently and radially deflectable inwardly towards the central axis of said housing; the forwardly facing end of said finger abutting the rear face of the annular shoulder of said coupling member, whereby said coupling member is mounted to said housing and may be removed from said housing by deflecting said finger.

4. The electrical connector as recited in claim 3 wherein there are a plurality of fingers integral with said housing.

* * * * *